US010605148B1

(12) United States Patent
Freund

(10) Patent No.: US 10,605,148 B1
(45) Date of Patent: Mar. 31, 2020

(54) SYSTEMS AND METHODS FOR CONTROLLING VEHICLE EXHAUST OUTPUT

(71) Applicant: Michael Freund, McHenry, IL (US)

(72) Inventor: Michael Freund, McHenry, IL (US)

( * ) Notice: Subject to any disclaimer, the term of this patent is extended or adjusted under 35 U.S.C. 154(b) by 89 days.

(21) Appl. No.: 15/378,598

(22) Filed: Dec. 14, 2016

(51) Int. Cl.
*F01N 13/18* (2010.01)
*F01N 1/16* (2006.01)
*F01N 3/28* (2006.01)

(52) U.S. Cl.
CPC ..... *F01N 13/1838* (2013.01); *F01N 1/165* (2013.01); *F01N 3/2892* (2013.01); *F01N 2450/00* (2013.01)

(58) Field of Classification Search
CPC ..... F02D 9/1065; F02D 11/04; F01N 13/087
See application file for complete search history.

(56) References Cited

U.S. PATENT DOCUMENTS 4,251,024 A * 2/1981 Feinberg ..... F23L 11/005 126/285 B
6,073,907 A * 6/2000 Schreiner, Jr. ..... F16K 31/043 251/129.12
7,428,892 B2 * 9/2008 Isogai ..... F16K 31/043 123/337
7,900,889 B2 * 3/2011 Tanghetti ..... F16K 31/607 251/287
8,888,571 B2 * 11/2014 Vincent ..... B60H 1/00521 454/69
10,060,360 B2 * 8/2018 Delplanque ..... F02D 9/04
2004/0099833 A1 * 5/2004 Haikawa ..... F16K 31/041 251/292
2013/0270470 A1 * 10/2013 Bonanno ..... F02D 9/1065 251/129.11
2014/0202556 A1 * 7/2014 Do Van ..... B60P 7/065 137/223
2017/0284310 A1 * 10/2017 Delplanque ..... F02D 9/04
2017/0342714 A1 * 11/2017 Babcock ..... E04D 3/362

* cited by examiner

*Primary Examiner* — Audrey K Bradley
*Assistant Examiner* — Anthony Ayala Delgado
(74) *Attorney, Agent, or Firm* — Underwood & Associates, LLC

(57) ABSTRACT

An article of manufacture includes a rigid plate, first and second tab members defined by a pair of substantially diametrically-opposed U-shaped apertures within the plate, and a third tab member defined by a U-shaped aperture proximal to the first and the second tab members. The article of manufacture can be used as an active exhaust defeat device, providing the capability of locking a butterfly valve of a vehicle active exhaust system in a desired orientation. Although the butterfly valve is locked, which may be a non-standard exhaust configuration, the article of manufacture provides that vehicle error codes specific to an exhaust valve actuator are avoided.

16 Claims, 9 Drawing Sheets

SYSTEMS AND METHODS FOR CONTROLLING VEHICLE EXHAUST OUTPUT

TECHNICAL FIELD

This disclosure relates to systems and methods for maintaining an exhaust control component in a preferred configuration. In particular, this disclosure relates to a defeat device for maintaining a noise- or emission-control valve within an exhaust system in an open configuration that avoids generation of controller-specific malfunction errors.

BACKGROUND

Vehicle exhaust systems can include assemblies, such as motor-driven valves for the purpose of controlling various aspects of exhaust output, for example, emissions or noise. In some cases, such assemblies are computer controlled and integrated with software or other feedback mechanisms that control vehicle exhaust as the vehicle runs.

For example, some vehicles include a motor-driven damper assembly wherein a butterfly valve is disposed in-line with the exhaust system. The butterfly valve can be shifted between open and closed configurations to control overall vehicle noise depending, e.g., on certain factors, such as engine RPM's, throttling, etc.

Certain vehicles are attractive to consumers due in part to the automotive power of the engine. While some consumers may prefer to leave exhaust control systems as provided by the manufacturer, others may choose to modify aspects of the vehicle to suit particular tastes. In one example, an owner of a vehicle having considerable horsepower may wish to experience the full range of sound that the vehicle produces during operation.

However, exhaust systems may be designed to reduce the sound via one or more control assemblies as mentioned. Removing the control assembly or modifying it in such a way that the assembly does not function as designed may lead to generation of error codes which can range, depending on the vehicle, from an annoyance to reduced vehicle performance. Thus, a defeat device that allows a vehicle owner to experience an otherwise controlled aspect, e.g., vehicle "loudness," while avoiding generation of vehicle-monitoring error codes would be advantageous.

SUMMARY

In one exemplary aspect, an article of manufacture is provided. The article of manufacture includes a rigid plate, first and second tab members defined by a pair of substantially diametrically-opposed U-shaped apertures within the plate, and a third tab member defined by a U-shaped aperture proximal to the first and the second tab members.

In one embodiment, the first and the second tab members extend from a top side of the plate, and the third member extends from a bottom side of the plate. In a related embodiment, the first, second and third tab members extend approximately perpendicularly from the plate. In one embodiment, a distance between a base of the first and the second tab is about 18.2 mm.

The article can further include first, second and third apertures for receiving a securement member. In a related embodiment, a distance between the first aperture and the second aperture is about 81.93 mm; a distance between the second aperture and the third aperture is about 77.69 mm; and a distance between the third aperture and the first aperture is about 61.58 mm. In a further related embodiment, the first, second and third tab members each include a tab base having a base midpoint. In one embodiment, a distance from the first aperture to the base midpoint of the first tab member is about 25 mm; a distance from the second aperture to the base midpoint of the second tab member is about 57 mm, and a distance from the third aperture to the base midpoint of the third tab member is about 19 mm.

In one embodiment, the first, second and third tab members each include a tab base, wherein the first tab base and the second tab base are substantially parallel, and the third tab base is oriented at a non-zero angle relative to the first tab base and the second tab base. In a related embodiment, the non-zero angle is about 142 degrees.

In another exemplary aspect, an active exhaust defeat device is described. In one embodiment, an active exhaust defeat device includes a rigid plate having top and bottom surfaces, first and second protrusions protruding from the top surface of the plate for confronting first and second contact points respectively of an active exhaust controller actuating member, and a third protrusion protruding from the bottom surface of the plate for confronting a portion of a rotatable vehicle exhaust butterfly valve.

In one embodiment, each of the first, second and third protrusions is a post, bracket, finger, arm, column, platform, plug, rib, shoe, shoulder, step, strut, or wall.

In one embodiment, the active exhaust defeat device further includes a first attachment aperture for securing the rigid plate to an attachment body proximal to the vehicle exhaust butterfly valve. In a related embodiment, the exhaust defeat device further includes second and third attachment apertures. In this embodiment, a distance between the first aperture and the second aperture is about 81.93 mm, a distance between the second aperture and the third aperture is about 77.69 mm, and a distance between the third aperture and the first aperture is about 61.58 mm.

In one embodiment, the first and the second protrusions are tabs that extend about 10.0 mm from the top surface of the rigid plate, and the third protrusion is a tab that extends about 13.2 mm from the bottom surface of the rigid plate. In a related embodiment, the first and the second tabs are parallel. In a further related embodiment, the third tab is oriented at an angle of about 142 degrees to the first tab.

In yet another exemplary aspect, a method for controlling an aspect of a vehicle exhaust system is disclosed. In one embodiment, the method includes providing an active exhaust defeat device. The active exhaust defeat device can be provided by forming first and second protrusions on a top surface of a rigid plate member of sufficient height to engage an actuating spring of an active exhaust controller at first and second contact points, respectively, forming a third protrusion on a bottom surface of the rigid plate member of sufficient height to engage a rotatable engagement member of a vehicle exhaust butterfly valve, and forming at least one aperture in the rigid plate for securing the rigid plate to an exhaust housing or plate proximal to the rotatable engagement member.

In one embodiment, the method further includes disposing the active exhaust defeat device between an active exhaust controller assembly and the exhaust housing or plate.

In one embodiment, the method, further includes rotating the rotatable engagement member to achieve a desired vehicle exhaust butterfly valve position, engaging the third protrusion with the rotatable engagement member, engaging the first and second protrusion with first and second contact points of the actuating spring, and securing the active exhaust controller and the active exhaust defeat device, and the active exhaust defeat device and the rotatable engagement member in a confronting relationship.

In one embodiment, of the method, each of the first, second and third protrusions are tab members, the first tab member is parallel with the second tab member, and the third tab member is oriented at an angle of about 142 degrees to the first and the second tab members.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

Figure 1:
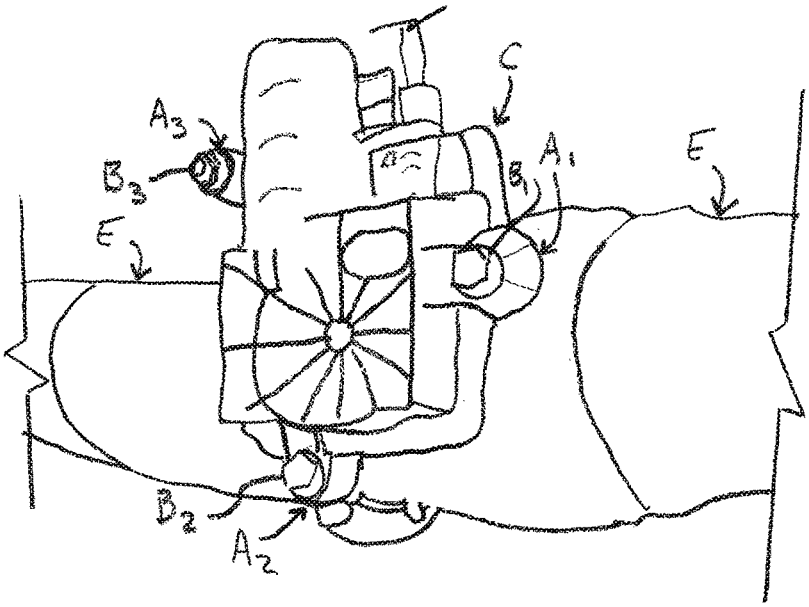
FIG. 1 (PRIOR ART)
FIG. 1 shows a prior art active valve exhaust assembly.

FIG. 1 shows a prior art vehicle exhaust pipe E having an electronically-controlled active valve exhaust controller C coupled thereto. In this exemplary prior art system, controller C is configured to shift a butterfly valve disposed within exhaust pipe E between open and closed positions to control one or more aspects of the vehicle's exhaust output, such as combustion emission, noise, or other factors. Controller C is in signal communication with the vehicle's on-board computer which can send and receive control and monitoring signals to and from the controller C respectively to control the position of the butterfly valve.

Figure 1A:
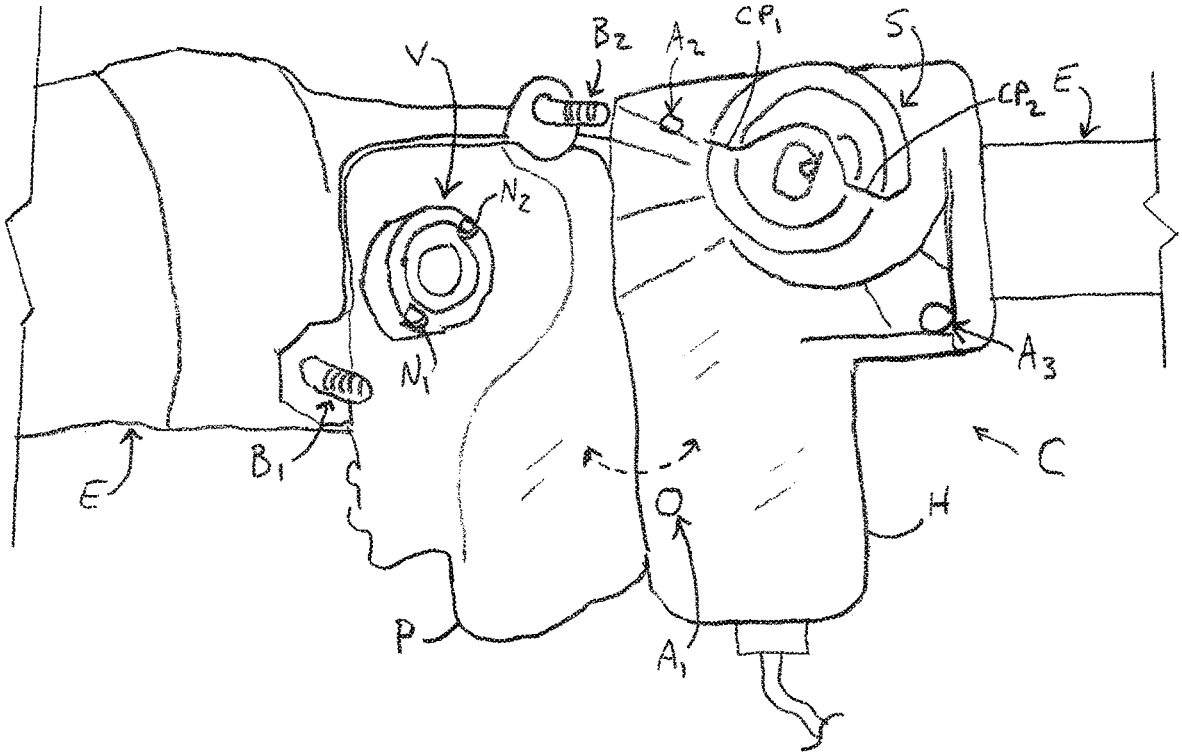
FIG 1A (PRIOR ART)
FIG. 1A shows the prior art active valve exhaust assembly of FIG. 1 in a disassembled configuration.

Referring to FIG. 1A, selected internal components of controller C are shown. In this prior art system, the controller C includes a plate P and a housing H that is removably secured to plate P by securement members, e.g., bolts $B_1$, $B_2$ and $B_3$ that are integral to, and extend from plate P. Housing H includes apertures $A_1$, $A_2$ and $A_3$ that are configured to allow bolts $B_1$, $B_2$ and $B_3$ to pass therethrough respectively; housing H can be secured to plate P by, e.g., applying nuts to each of bolts $B_1$, $B_2$ and $B_3$ and tightening.

In this prior art system, spring S of controller C is an actuating member and is configured to engage notches $N_1$ and $N_2$ on valve plate V at contact points $CP_1$ and $CP_2$ respectively. The controller C is configured to rotate spring S through a range of approximately ninety degrees in clockwise- and counter-clockwise directions according to control signals received from the vehicle's on-board computer. This, in turn rotates valve plate V which is connected to the butterfly valve internal to exhaust pipe E (not visible in FIG. 1 or 1A) to open or restrict exhaust flow therethrough. One exemplary controller C is a Dodge Actuator-Exhaust Valve, Part Number 68239269AF.

Figure 2:
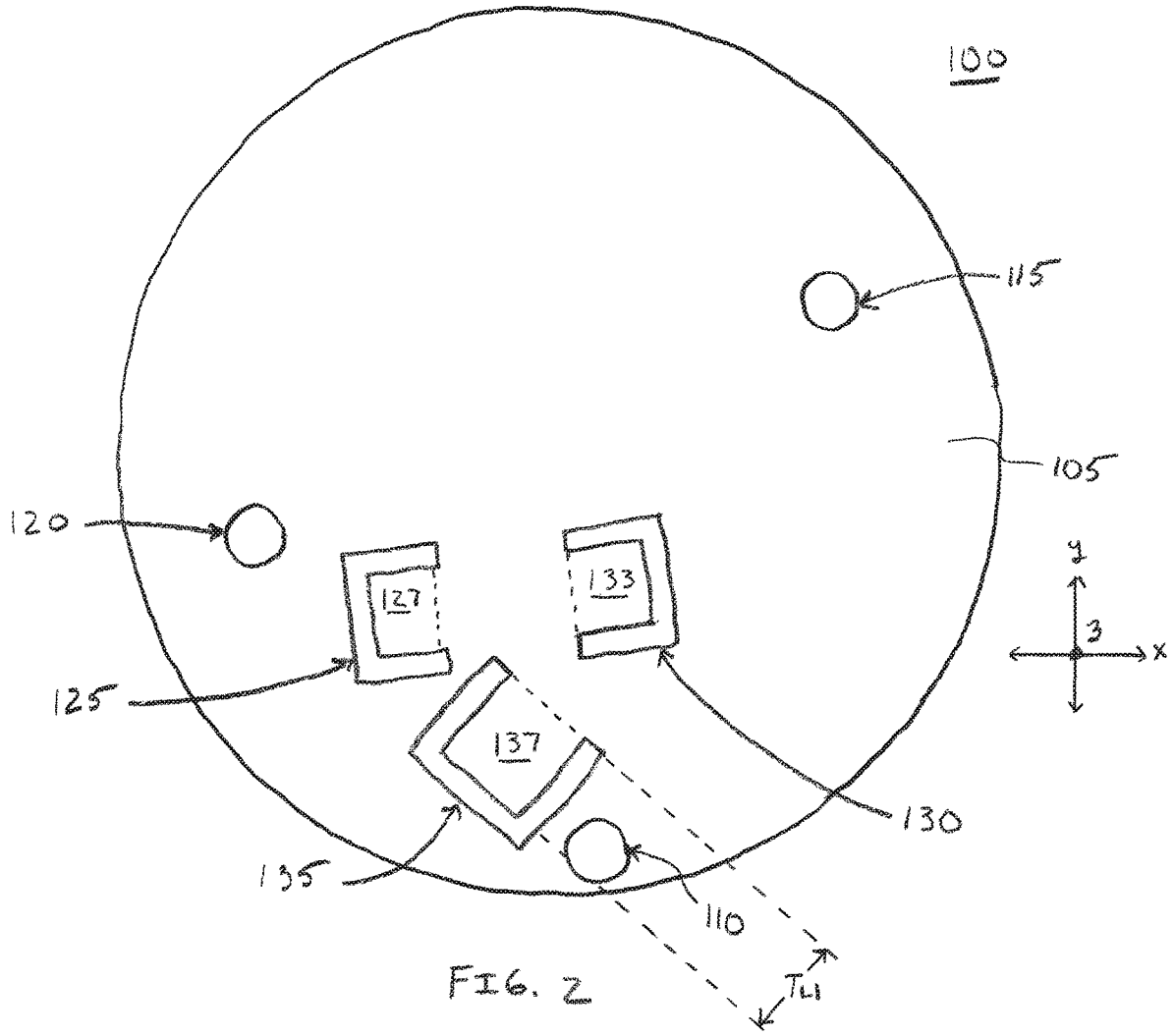
FIG. 2 is an active exhaust defeat device (AEDD) according to one embodiment.

Referring now to FIG. 2, an active exhaust defeat device (hereinafter 'AEDD') 100 is illustrated according to one embodiment. The AEDD 100 is a defeat device that can be interposed between the plate P and housing H of controller C to lock valve V and, correspondingly, the exhaust butterfly valve (not shown) within exhaust pipe E in a selected orientation. Furthermore, as will be discussed below, AEDD 100 achieves the aforestated functionality without causing vehicle computer error codes to be generated or requiring mechanical modifications such as removing the valve V or butterfly valve entirely to achieve a desired exhaust characteristic such as loudness.

In this embodiment, AEDD 100 includes a rigid plate 105. The plate 105 is preferably formed of metal or a resilient polymer material that can withstand the heat generally formed in the proximity of a vehicle exhaust pipe. One non-limiting exemplary material is ⅛"-thick aluminum plate.

In this embodiment, apertures 110, 115 and 120 disposed in plate 105 such that bolts $B_1$, $B_2$ and $B_3$ of controller plate P will pass therethrough. In a preferred embodiment, the diameters and location of apertures 110, 115 and 120 are formed with a minimum tolerance to reduce the likelihood of the plate 105 shifting with respect to plate P of the controller C and to prevent rattle. Apertures 110, 115 and 120 can be formed, e.g., by drilling appropriately-sized holes in the plate 105 material at locations corresponding to the positions of bolts $B_1$, $B_2$ and $B_3$.

Figure 8:
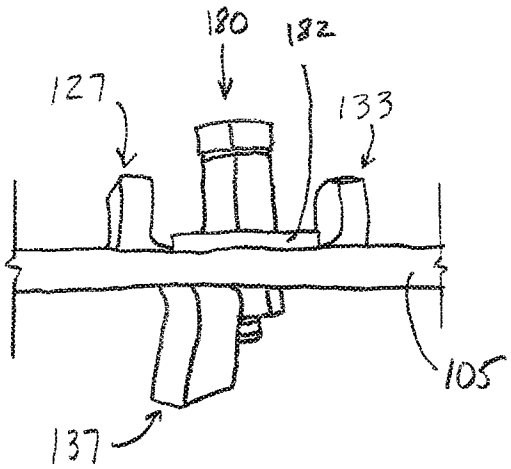
FIG. 8 shows a perspective view of a section of an AEDD according to one embodiment.

In this embodiment, plate 105 includes a plurality of protrusions, in this example, tab members 127, 133 and 137. In this embodiment, tab members 127, 133 and 137 are each respectively formed by cutting U-shaped channels 125, 130, 135 in plate 105 and bending the plate material along the dashed lines where indicated. Alternative protrusion types can include, without limitation, posts, brackets, fingers, arms, columns, platforms, plugs, ribs, shoes, shoulders, steps, struts, or walls. In the view shown in FIG. 2, tabs 127, 133 and 137 are parallel with the plane of plate 105; when configured for use, however, tabs 127 and 133 extend substantially perpendicularly in the +z direction (toward the viewer when viewing FIG. 2), and tab 137 extends substantially perpendicularly in the -z direction (away from the viewer when viewing FIG. 2). (See also, FIGS. 8 and 9.) The dashed lines in FIG. 2 illustrate approximate locations where tabs 127, 133 and 137 are bent upwardly or downwardly as described. FIG. 8 illustrates the orientation of tabs 127, 133 and 137 in an operable configuration, according to one embodiment.

As stated previously, in this embodiment AEDD 100 is configured to be interposed between plate P and housing H of controller C. In such a configuration, the position of tab 137 relative to apertures $A_1$, $A_2$ and $A_3$, and its orientation is such that it can engage notch $N_1$ or $N_2$ of valve V when the AEDD 100 is coupled to, or engaged with plate P. A consideration during manufacture of AEDD 100, therefore, is that the tab length $T_L$, e.g., $T_{L1}$ of tab 137 (FIGS. 2 and 6) is sufficient to engage notch $N_1$ or $N_2$ when the AEDD 100 is coupled to, or engaged with plate P.

To install the AEDD 100, a user can first manipulate valve V as desired, e.g., manually, to open or close the exhaust butterfly valve coupled thereto. The AEDD 100 can then be placed on plate P, feeding bolts $B_1$, $B_2$ and $B_3$ through apertures $A_1$, $A_2$ and $A_3$ as previously described. Plate 105 can be secured to plate P through the use of a nut or, in a preferred approach, a threaded spacer as described below. In such a configuration, valve V is locked in the selected position through the engagement of tab 137 with notch $N_1$ or $N_2$.

Figure 3:
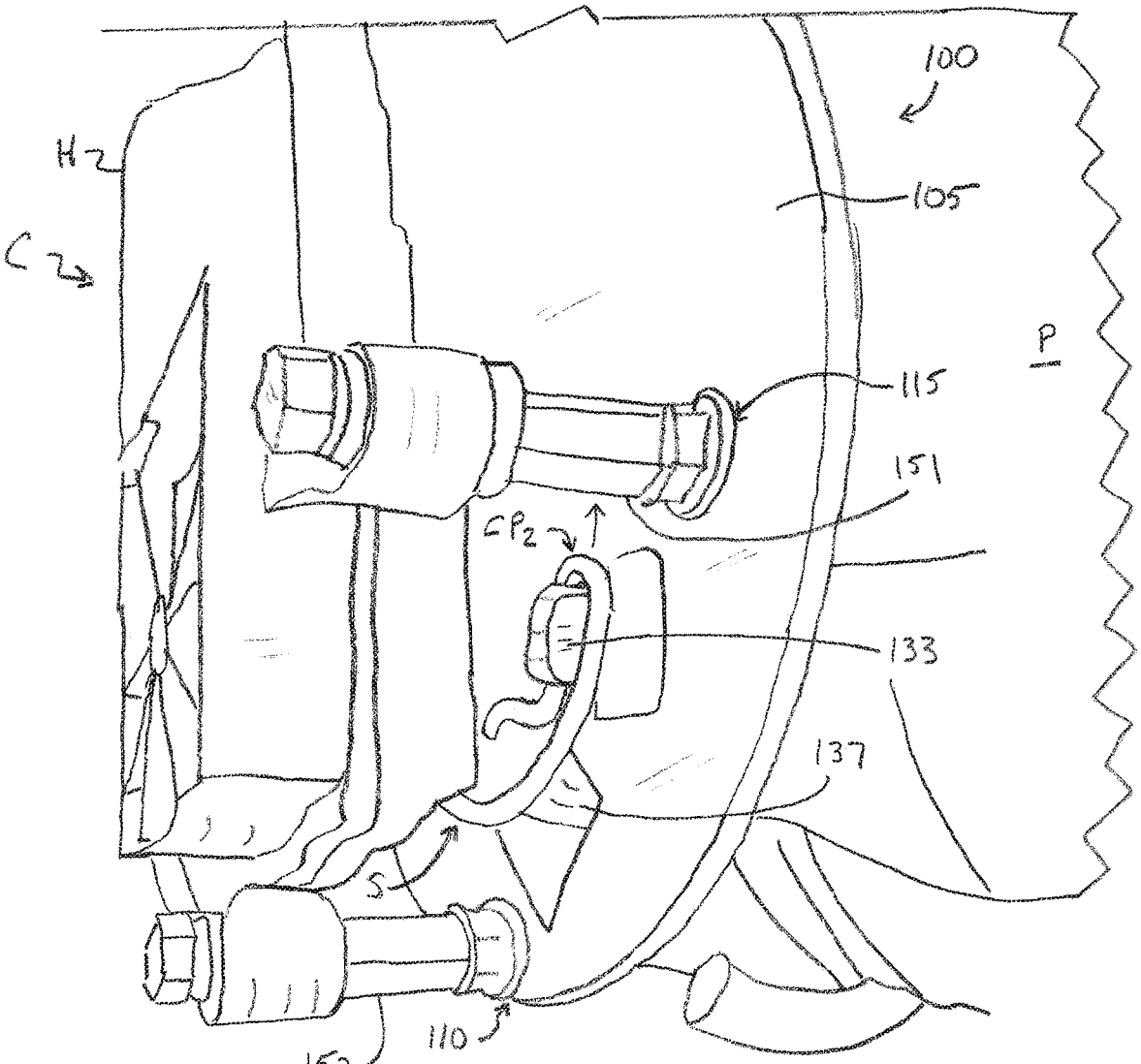
FIG. 3 illustrates an AEDD interposed between a controller housing and an exhaust plate, according to one embodiment.
Figure 4:
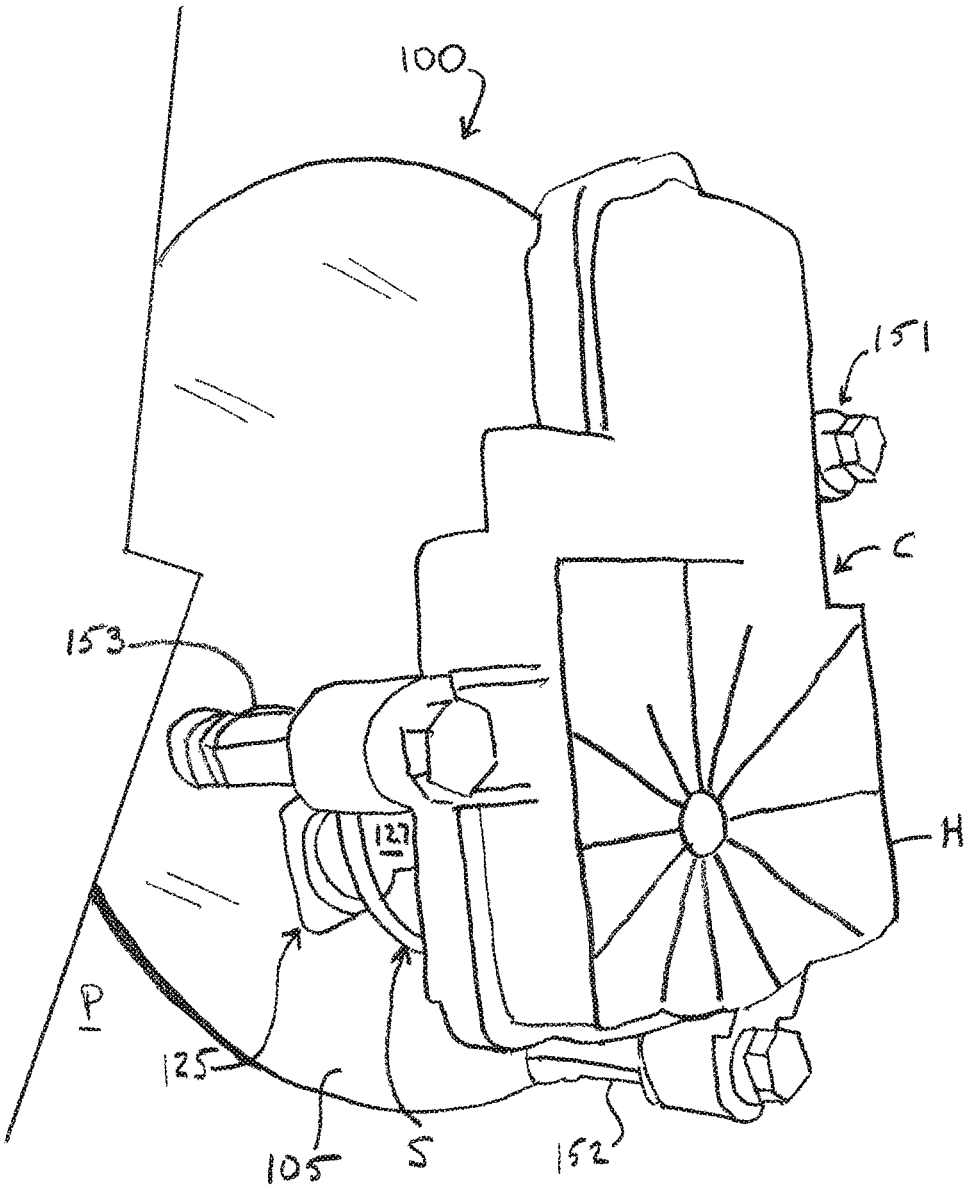
FIG. 4 illustrates an AEDD interposed between a controller housing and an exhaust plate, according to one embodiment.
Figure 5:
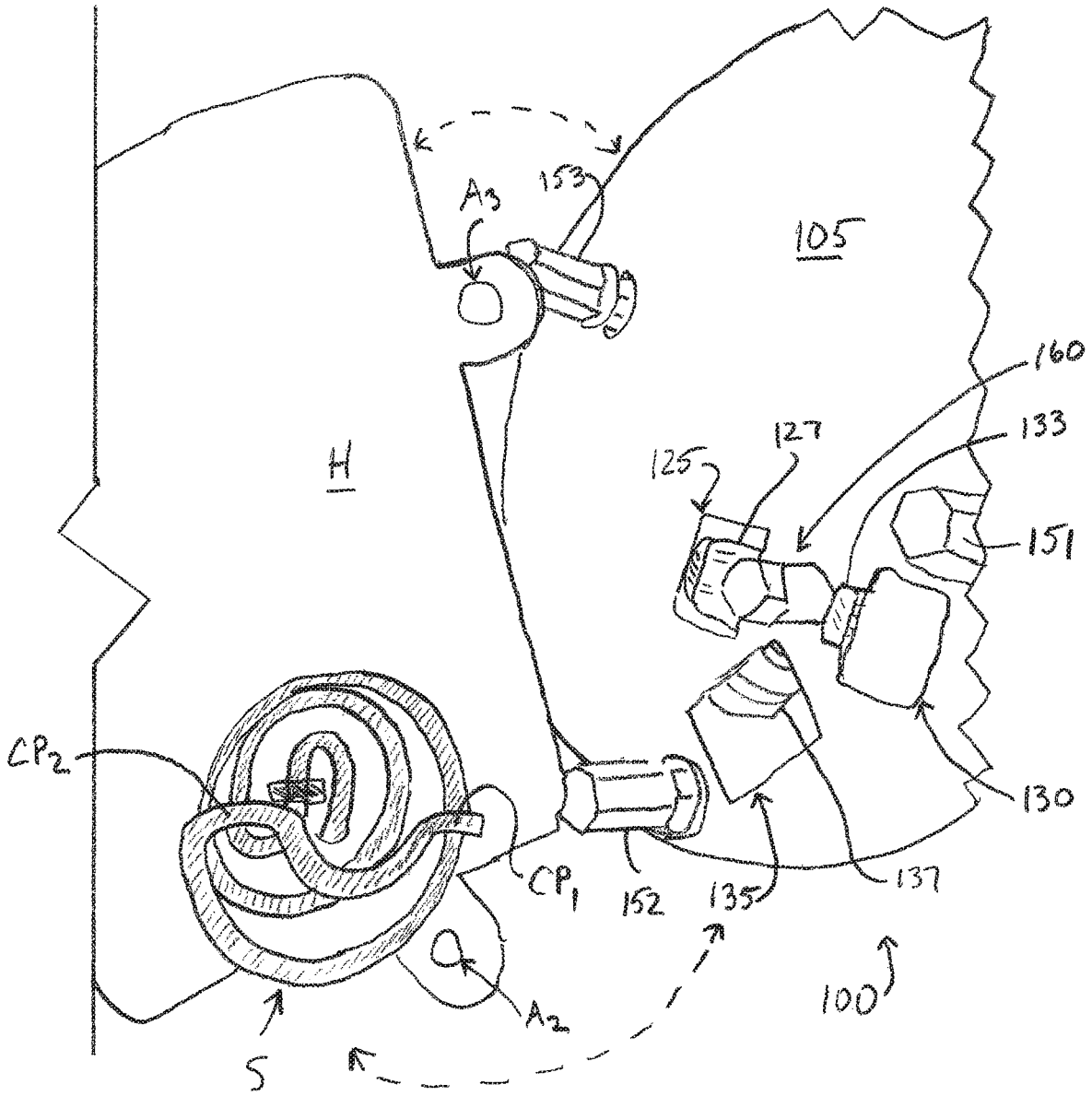
FIG. 5 illustrates the mating of a controller housing with an AEDD, according to one embodiment.

Referring now to FIGS. 3 and 4, in this embodiment, tabs 127 and 133 are configured to engage spring S of controller C at contact points $CP_1$ and $CP_2$, respectively. It should be understood that, since spring S may rotate freely in some controllers C, during set-up, tab 127 may engage spring S at contact point $CP_2$ and tab 133 may engage spring S at contact point $CP_1$.

In this embodiment, tabs 127 and 133 function as stop members that allow spring S to rotate within a selected angular range, e.g., a range of ninety (90) degrees that correlates to fully open and fully closed positions of the butterfly valve within exhaust pipe E. Referring to FIG. 3 in particular, contact point $CP_2$ of spring S is shown engaged with tab 133. For the prior-art controller C shown, contact point $CP_2$ of spring S includes a U-shaped bend that can partially encircle tab 133 as illustrated.

Normally, when controller C receives control signals by the vehicle's on-board computer or other controlling system to open or close the exhaust butterfly valve, controller C rotates spring S as previously described. However, when the AEDD 100 is interposed between plate P and controller housing H, spring S slides across plate 105 without engaging valve V or altering the position or orientation of the exhaust butterfly valve.

Prior-art controllers such as controller C can be configured with one or more sensors to detect malfunctions or jams in the operation of the vehicle's butterfly valve or if the butterfly valve or spring S are rotating beyond a predetermined set point. When detected, such actions usually trigger a warning or fault indicator to be displayed so that the operator can address the problem. However, in this embodiment, the position of tabs 127 and 133 of AEDD 100 are such that the rotation of spring S is limited to what would be the normal range of angular travel if the AEDD 100 were not interposed between plate P and controller housing H. For example, referring to FIG. 3, when spring S rotates in the direction indicated by the arrow, contact point $CP_2$ disengages tab 133 (correspondingly, contact point $CP_1$ disengages tab 127), and the spring S can rotate until contact point $CP_2$ confronts tab 127, where it is thereby prevented from rotating further (correspondingly, contact point $CP_1$ will confront tab 133). In layman's terms, this configuration 'tricks' the controller into believing that spring S has been rotated between its preset stop points, such that a controller fault is not generated, even though the position of valve V and the exhaust butterfly valve remains unchanged.

Figure 6:
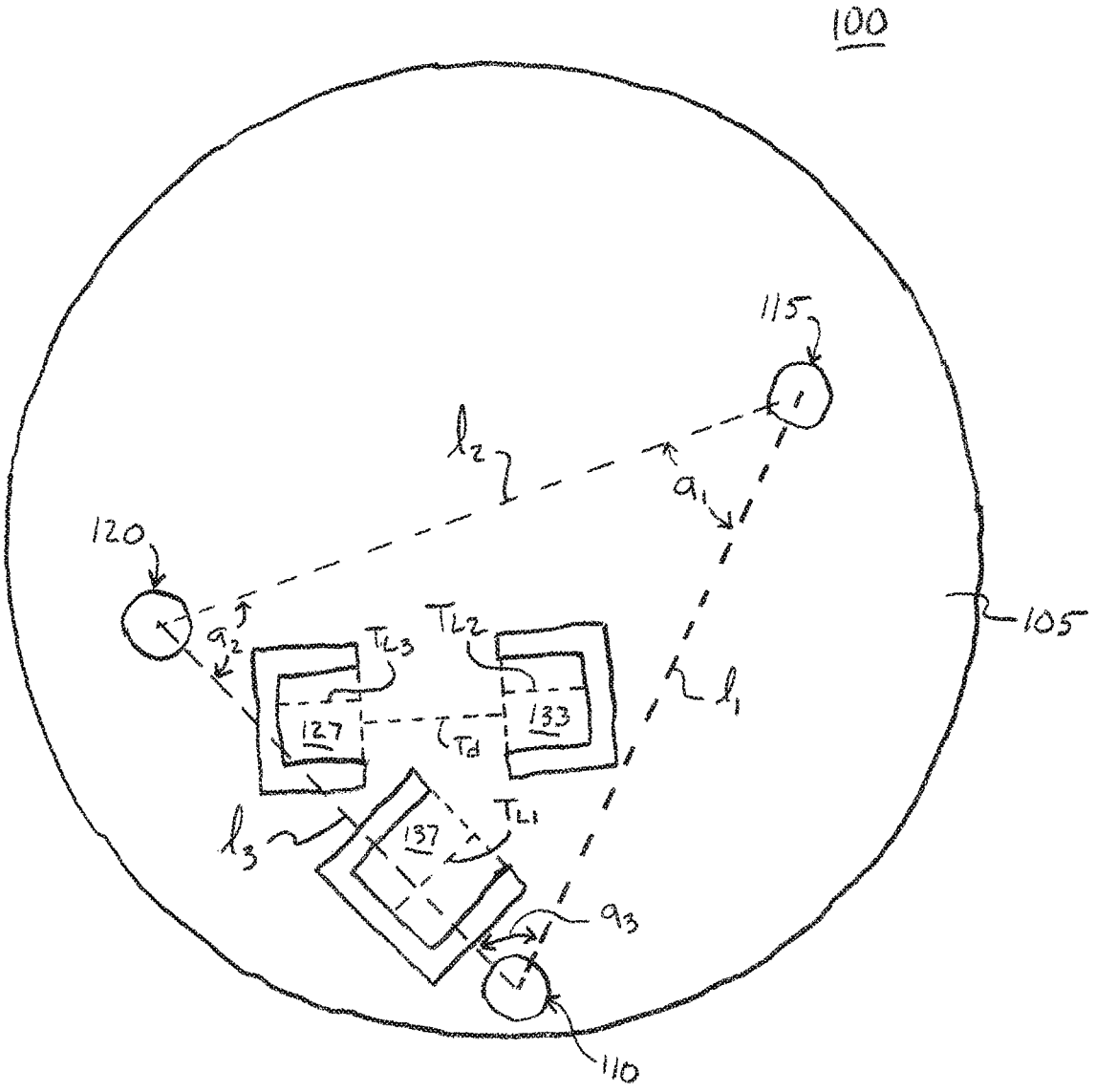
FIGS. 6 and 7 illustrate various dimensions and measurements of an AEDD according to one embodiment.

Referring now to FIG. 6, in this and other embodiments, the relative position and orientation of the tabs, e.g., tabs 127, 133 and 137, or the relative positions between tabs (e.g., tabs 127, 133 and 137) and apertures (e.g., apertures 110, 115 and 120), or both, can be chosen so that the AEDD 100 is operable for its intended use on a particular style, brand, arrangement or other facet of an exhaust controller. For example, the AEDD 100 illustrated in FIG. 6 is configured for use with a Dodge Actuator-Exhaust Valve, Part Number 68239269AF; such controllers are commonly configured for use with Dodge Challenger SRT® Hellcat model vehicles, although the AEDD 100 can be used with other controllers if the relative dimensions that follow correspond to the internal components of the controller and butterfly valve controller as described herein.

For example, in the AEDD 100 embodiment illustrated in FIG. 6, the length h between the center of aperture 110 and the center of aperture 115 is about 81.93 mm; the length 12 between the center of aperture 115 and the center of aperture 120 is about 77.69 mm; and the length 13 between the center of aperture 120 and the center of aperture 110 is about 61.58 mm. In this embodiment, the aforestated measurements can be varied by about ±9.5 mm. In this embodiment, the angle $a_1$ between lengths $l_1$ and $l_2$ is about 45.31°; the angle $a_2$ between lengths $l_2$ and $l_3$ is about 70.95°; and the angle $a_3$ between lengths $l_3$ and $l_1$ is about 63.73°. In this embodiment, the aforestated angles can be varied by about ±3°. It should be understood that while circular apertures are preferred, apertures 110, 115 and 120 can be of an alternative shape. However, in the preceding, the center of aperture refers to the aperture location where bolts of plate P, e.g., bolts $B_1$, $B_2$ and $B_3$ (e.g., FIG. 1) would normally come through when the AEDD 100 is disposed between controller housing H and plate P as described herein.

In this embodiment, the lengths of tabs 127, 133 and 137, corresponding to lengths $TL_3$, $TL_2$ and $TL_1$ respectively are about 10.09 mm, about 10.09 mm and about 13.23 mm. It should be understood that, in this embodiment, tab members 127, 133 and 137 are formed by bending plate 105 material approximately along the dashed lines between opposite ends of the U-shaped channels 125, 130 and 135 as illustrated; however, other tab configurations can be used, such as by direct welding onto plate 105. In this embodiment, the distance $T_d$ between the base of tabs 127 and 133 is about 18.17 mm.

Figure 7:
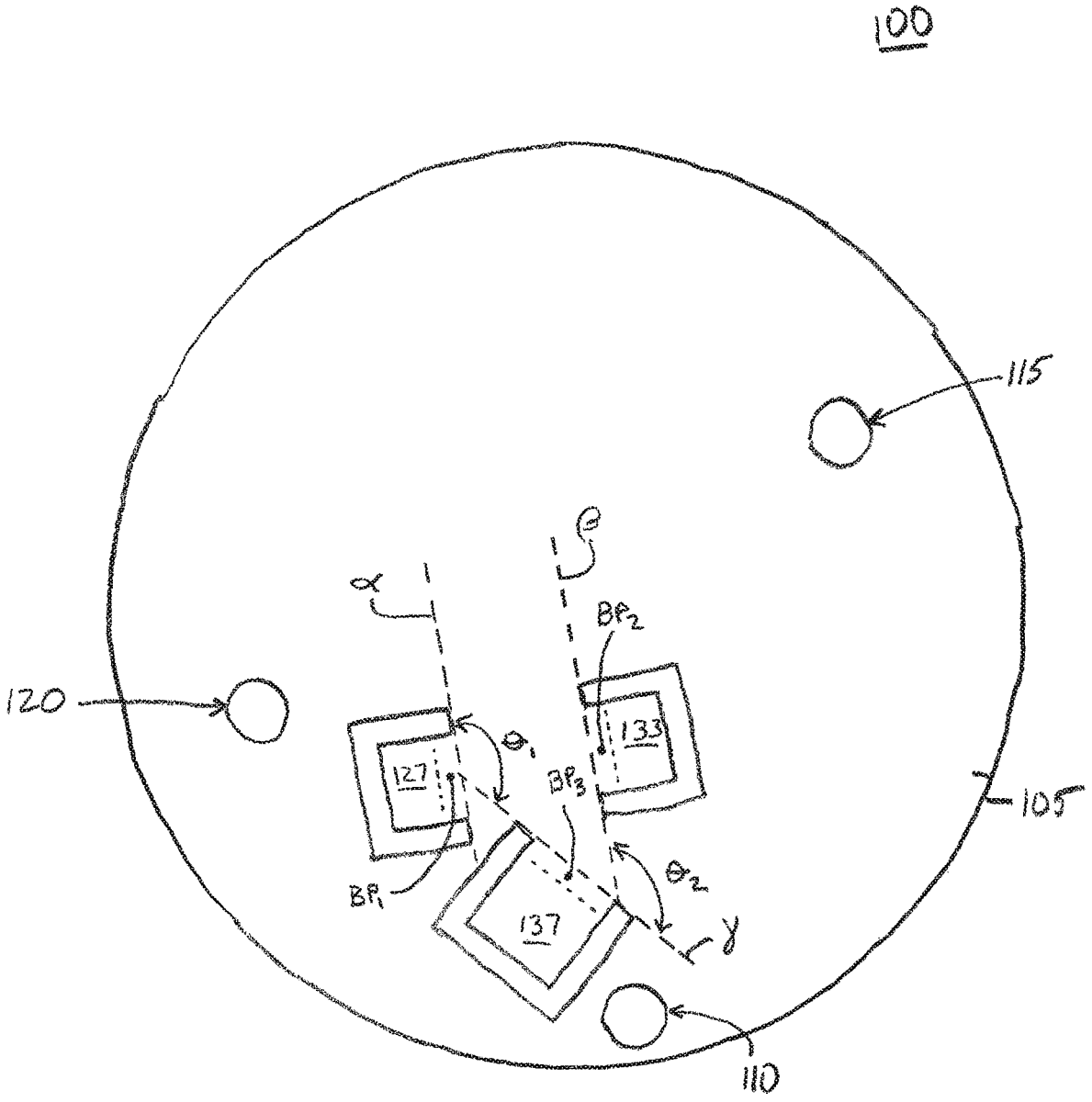

Referring to FIG. 7, in this embodiment, the relative orientation of tab members, e.g., tab members 127, 133 and 137 can be selected so that the interposition of AEDD 100 between housing H and plate P of controller C operably seats spring S with respect to tabs 127 and 133 and valve V notch $N_1$ or $N_2$ as desired. Controller C and valve V are not depicted in FIG. 7 for the sake of figure clarity. In this embodiment, U-shaped channels 125 and 130 are diametrically opposed as illustrated. The 'tops' of each U-shaped channel define lines α, β and γ (shown in dashed lines) that are substantially parallel with the base of each tab 127, 133, and 137, respectively, as illustrated. It should be understood that, in FIG. 7, AEDD 100 is shown prior to tabs 127, 133 and 137 being operably configured, i.e., tabs 127 and 133 being bent in an upward direction and tab 137 being bent in an opposite, downward direction. The approximate location of each tab base is illustrated as being between lines α, β and γ and the dotted line illustrated on each tab, respectively. A center base position $BP_1$, $BP_2$ and $BP_3$ is shown for each of tabs 127, 133 and 137, respectively.

In this embodiment, lines α and β are substantially parallel. Line γ forms an angle $\theta_1$ and $\theta_2$ with lines α and β respectively; and, in this embodiment, angles $\theta_1$ and $\theta_2$ are approximately congruent. In this embodiment, angles $\theta_1$ and $\theta_2$ are approximately 142°. In this embodiment, base position $BP_1$ is approximately 25 mm from aperture 120; base position $BP_2$ is approximately 57 mm from aperture 115 and base position $BP_3$ is approximately 19 mm from aperture 110. In each of the aforestated measurements, the distance can vary by about ±5 mm.

In this and other embodiments, AEDD 100 can be used to control an aspect of vehicle exhaust, such as vehicle emissions output or loudness. One method for controlling an aspect of vehicle exhaust includes first disassembling an active exhaust controller, e.g., controller C to expose housing H, valve V and plate P as previously described. Next, the position of valve V can be set, e.g., manually, which correspondingly sets the position of the exhaust butterfly valve connected thereto in a desired orientation, e.g., open, closed, or a position therebetween. Next, AEDD 100 can be placed onto plate P such that bolts B1, B2 and B3 pass through apertures 110, 120 and 115 respectively, and tab 137 engages notch $N_1$ or $N_2$ of valve V.

Next, a threaded spacer nut 151, 152, 153 (FIGS. 3 and 4) can be threaded onto each of bolts $B_1$, $B_2$ and $B_3$, respectively, which forcibly confronts AEDD 100 with plate P and locks valve V in the desired orientation. Spacer nuts 151, 152 and 153 should preferably be shorter than the length of bolts $B_1$, $B_2$ and $B_3$ so that the housing H can be connected thereto. Next, controller housing H can be placed such that the terminal end portions of bolts $B_1$, $B_2$ and $B_3$ extend through apertures $A_1$, $A_2$ and $A_3$, respectively, of housing H. In doing so, spring S can engage tabs 127 and 133 at contact points $CP_1$ and $CP_2$ or vice-versa. Next, a securement member such as a cap nut can be threaded onto the terminal end portions of bolts $B_1$, $B_2$ and $B_3$ to secure the housing H.

Following the above steps, now when controller C receives control signals from the vehicle's on-board computer to control exhaust valve V (and thereby, the exhaust butterfly valve), spring S rotates on the surface of plate 105 without affecting the configuration of valve V. In this way, AEDD 100 defeats the on-board vehicle exhaust control system by allowing controller C to respond to control signals without affecting actual change of exhaust valve V. Because the controller C behaves normally to the vehicles control input signals, the AEDD 100 substantially prevents the generation of error or malfunction codes that may otherwise be arise by forcing valve V in a desired configuration or removing valve V entirely.

Figure 9:
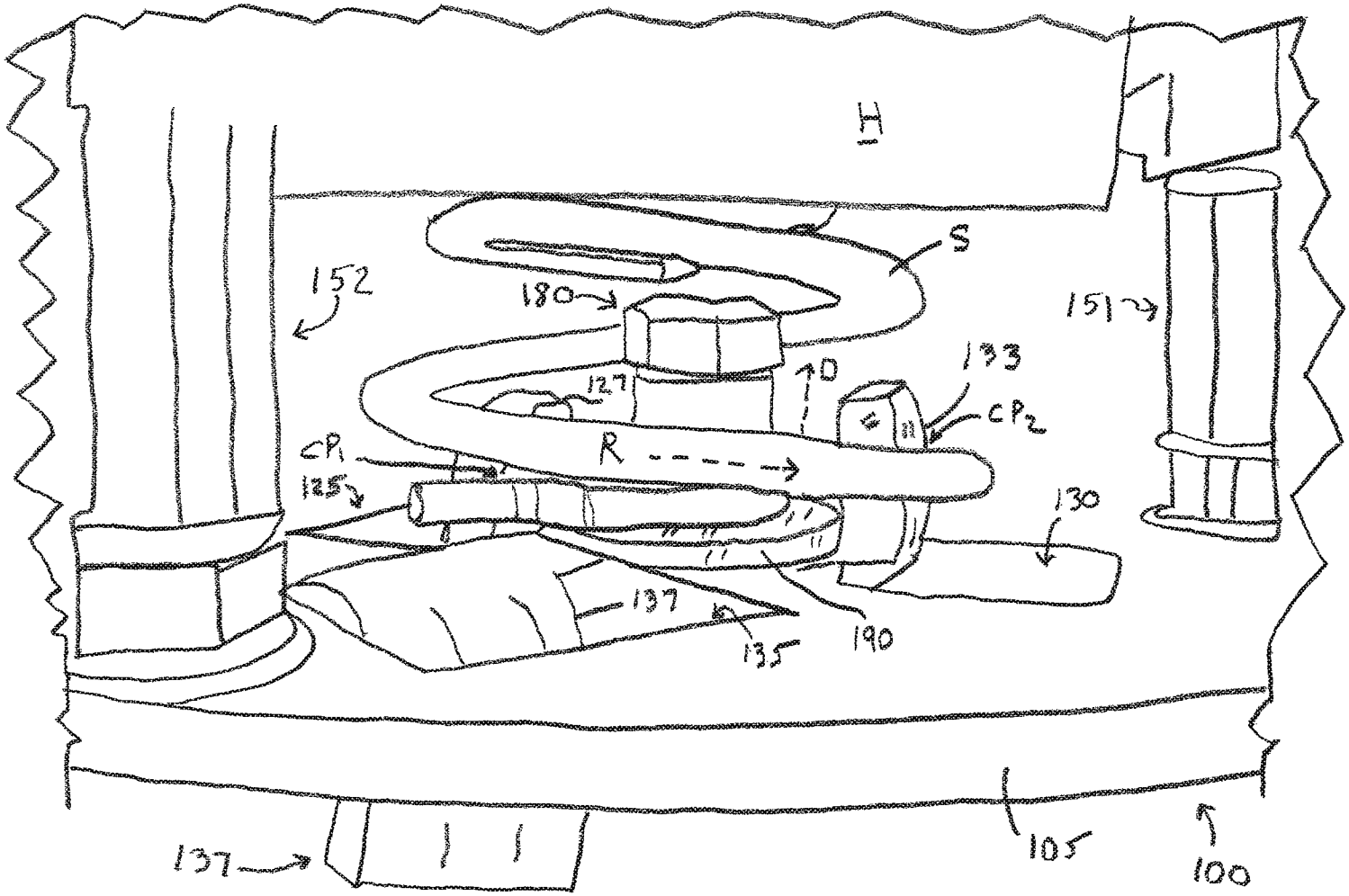
FIG. 9 shows a perspective view of a section of an AEDD, according to one embodiment.

Referring now to FIG. 9, a perspective view of AEDD 100 is shown according to one embodiment. In FIG. 9, AEDD 100 is disposed between housing H and plate P (although plate P is not shown for figure clarity) and represents an operable configuration according to one embodiment. In this and other embodiments, it can be preferable to account for the helical nature of spring S when determining optimal tab lengths $T_{L1}$ and $TL_2$ of tabs 127 and 133. For example, dashed line R represents a rotation direction of spring S when controller C is activated, for example, to open valve V (not shown). As spring S rotates in the indicated direction, its body, as measured at a given point, e.g., at tab 133 rises in the direction D as illustrated. Thus, in a preferred embodiment, tab 133 should be of a length $T_L$ that avoids interference with spring S as it rotates, at points other than contact points $CP_1$ and $CP_2$ as described herein.

In this embodiment, elongate post 180 can be disposed coaxially with the axis of spring S rotation. In the event of a catastrophic failure of the connection of spring S with housing H, post 180 can prevent spring S from falling out onto a roadway, which could present a hazard to other motorists. In this embodiment, a bushing 190 is coaxially disposed with post 180 as illustrated, which provides a surface on which a portion of spring S can ride, to reduce contact wear with plate 105. In such an embodiment, an aperture can be disposed in plate 105 within the boundary defined by the triangle connecting apertures 110, 115 and 120, substantially coaxial with the rotation axis of spring S. An end portion of post 180 can be inserted through the aperture and coupled with plate 105 by various methods, e.g., by welding or securing by a nut or threaded engagement with plate 105.

A number of illustrative embodiments have been described. Nevertheless, it will be understood that various modifications may be made without departing from the spirit and scope of the various embodiments presented herein. For example, while plate 105 is illustrated having a generally circular shape, such a shape is not required and any other shape can be used. The specific measurements provided herein are sufficient for the make and model vehicle described; however, it should be understood that the various measurements disclosed herein can be adjusted or modified as necessary to affect the same or similar function as described on other vehicle exhaust systems or with other controller systems or configurations. The tab members that engage the controller spring S and valve notches $N_1/N_2$ can be any desired type of protrusion that extends from plate 105, such as tab members being welded to plate 105, fingers or juts that extend therefrom, etc. Accordingly, other embodiments are within the scope of the following claims.

What is claimed is:

1. An article of manufacture, comprising:

a rigid plate;

first and second tab members defined by first and second diametrically-opposed U-shaped apertures within said plate; and a third tab member defined by a third U-shaped aperture proximal to said first and said second tab members; wherein said third tab member is configured to engage a portion of a rotatable vehicle exhaust butterfly valve.

2. The article of manufacture of claim 1, wherein said first and said second tab members are configured to extend from a top side of said plate and said third tab member is configured to extend from a bottom side of said plate.

3. The article of manufacture of claim 2, wherein said first, second and third tab members extend approximately perpendicularly from said plate.

4. The article of manufacture of claim 1, wherein a distance between a base of said first and said second tab is 18 mm.

5. The article of manufacture of claim 1, further comprising first, second and third apertures for receiving a securement member.

6. The article of manufacture of claim 5, wherein:

a distance between said first aperture and said second aperture is 82.0 mm;

a distance between said second aperture and said third aperture is 77.5 mm; and a distance between said third aperture and said first aperture is 61.5 mm.

7. The article of manufacture of claim 6, wherein:

said first, second and third tab members each comprise a tab base having a base midpoint;

a distance from said first aperture to said base midpoint of said first tab member is 25 mm;

a distance from said second aperture to said base midpoint of said second tab member is 57 mm; and a distance from said third aperture to said base midpoint of said third tab member is 19 mm.

8. The article of manufacture of claim 1, wherein:

said first, second and third tab members each comprise a tab base;

wherein said first tab base and said second tab base are parallel; and wherein said third tab base is oriented at a non-zero angle relative to said first tab base and said second tab base.

9. The article of manufacture of claim 8, wherein said non-zero angle is 142 degrees.

10. The article of manufacture of claim 1, wherein said rigid plate is circular.

11. The article of manufacture of claim 1, wherein said rigid plate has a thickness of ⅛ inch.

12. The article of manufacture of claim 1, wherein each of said first and said second tab members are configured to engage a portion of a vehicle active exhaust controller actuating member.

13. The article of manufacture of claim 12, wherein said portion of said vehicle active exhaust controller is a spring or helically-wound wire.

14. An article of manufacture, comprising:

a rigid plate;

first and second tab members defined by first and second diametrically-opposed U-shaped apertures within said plate; and a third tab member defined by a third U-shaped aperture proximal to said first and said second tab members;

wherein:

each of said first and said second tab members are configured to engage a portion of a vehicle active exhaust controller actuating member; and wherein said third tab member is configured to engage a portion of a rotatable vehicle exhaust butterfly valve.

15. The article of manufacture of claim 14, wherein said rigid plate comprises a top surface and a bottom surface opposite the top surface; and wherein each of said first and said second tab members extend ten (10) mm from said top surface; and wherein said third tab member extends ten (10) mm from said bottom surface.

16. The article of manufacture of claim 14, wherein said first tab member extends ten (10) mm from said top surface, and wherein said second tab member extends less than ten (10) mm from said top surface.

* * * * *